United States Patent [19]

Koch

[11] 4,073,134

[45] Feb. 14, 1978

[54] GAS TURBINE COMBUSTOR FED BY A PLURALITY OF PRIMARY COMBUSTION CHAMBERS

[75] Inventor: Hans Koch, Zurich, Switzerland

[73] Assignee: BBC Brown Boveri & Company, Limited, Baden, Switzerland

[21] Appl. No.: 564,480

[22] Filed: Apr. 2, 1975

[30] Foreign Application Priority Data

Apr. 3, 1974 Switzerland ..... 4664/74

[51] Int. Cl.[2] ..... F02C 9/14; F02G 3/00

[52] U.S. Cl. ..... 60/39.29; 60/39.65; 60/39.69 R; 60/39.82 P

[58] Field of Search ..... 60/39.82 P, 39.74 R, 60/39.69, 39.29, 39.65, DIG. 11, 39.71, 39.37, 263; 431/175

[56] References Cited

U.S. PATENT DOCUMENTS

| | | | |
|---|---|---|---|
| 2,406,926 | 9/1946 | Summerfield | 60/258 |
| 2,518,000 | 8/1950 | Goddard | 60/263 |
| 2,595,765 | 5/1952 | Clarke et al. | 60/39.65 |
| 2,674,846 | 4/1954 | Bloomer et al. | 60/39.82 P |
| 2,777,291 | 1/1957 | Darling | 60/39.65 |
| 2,782,593 | 2/1957 | Lee et al. | 60/39.72 R |
| 2,814,339 | 11/1957 | Aubert | 60/39.82 P |
| 2,885,858 | 5/1959 | Lloyd | 60/39.69 X |
| 3,392,909 | 7/1968 | Turner | 60/39.29 X |
| 3,394,265 | 7/1968 | Hendrickson | 60/39.29 X |
| 3,612,737 | 10/1971 | Sharan | 431/183 |
| 3,751,910 | 8/1973 | Sweeney et al. | 60/39.65 |

OTHER PUBLICATIONS

Wade et al., "Low Emissions Combustion for Regenerative Gas Turbine," ASME Paper, No. 73-6T-11, Dec. 1973, pp. 33, 34, 44, 45.

*Primary Examiner*—Carlton R. Croyle
*Assistant Examiner*—Thomas I. Ross
*Attorney, Agent, or Firm*—Kenyon & Kenyon, Reilly, Carr & Chapin

[57] ABSTRACT

The system has a plurality of small primary combustion chambers which lead into a larger secondary combustion chamber in order to reduce the amount of nitrous oxides produced during combustion and thus, lower, pollution. The primary combustion chambers are arrayed in a spherical pattern to eliminate the need for individual ignition devices and to provide a better mixing effect and a more uniform temperature distribution within the secondary combustion chamber.

6 Claims, 5 Drawing Figures

GAS TURBINE COMBUSTOR FED BY A PLURALITY OF PRIMARY COMBUSTION CHAMBERS

This invention relates to a gas turbine combustion system and a method of operating the same.

As is known, conventional gas turbine combustion systems usually consist of a large and substantially cylindrical combustion chamber to which a fuel and air supply is connected via a burner. In addition, some of the air is supplied in the form of swirled air near the burner mouth while the remainder reaches the combustion chamber via apertures distributed in the combustion chamber wall. It is also known that $NO_x$ forms during combustion in combustion systems of this kind, i.e. nitrous oxides form from the nitrogen in the air for combustion. After the gases have performed work in the gas turbine, the nitrous oxides flow off to atmosphere together with the gases. Since nitrous oxides pollute the environment, attempts are in progress to reduce the $NO_x$ formation in the combustion processes. For example, the official requirements in the USA specify a $NO_2$ content not in excess of 5.4 g per kg of fuel.

Accordingly, it is an object of the invention to reduce the production of nitrous oxides during combustion in a gas turbine combustion system. Briefly, the invention provides a gas turbine combustion system comprising a plurality of small primary combustion chambers, each of which has a fuel and air supply means connected thereto, and a large secondary combustion chamber having the primary combustion chambers leading thereinto.

The division of the combustion process over a large number of small primary combustion chambers reduces the retention time of the air for combustion in the high-temperature zone of the flame so that only very small quantities of nitrous oxides are formed. The flame temperature in the secondary combustion chamber common to all the primary combustion chambers is much lower than in the primary combustion chambers, so that the $NO_x$ formation in the secondary combustion chamber is only insignificant. The method of operating the system is also essential to the low $NO_x$ formation in the combustion system according to the invention and in this method, the air supply to each primary combustion chamber is so adjusted that the excess-air coefficient $\lambda$ is at least 2. Since the dimensions of the common secondary chamber are relatively large as compared with the primary combustion chambers, another advantage obtained is that burning is more complete in the secondary combustion chamber so that the CO content of the gases is also very low.

In one advantageous embodiment, the outlet apertures of the primary combustion chambers are distributed spherically or substantially spherically relative to the secondary combustion chamber. The advantage of this arrangement is that a compact flame forms in the secondary combustion chamber. A compact flame of this kind is very favorable to ensure perfect ignition in the primary combustion chambers by the flame when these chambers are put into operation successively either individually or in groups. In this case, therefore, there is no need for each primary combustion chamber to have its own ignition device. Another advantage of disposing the primary combustion chambers spherically, for example, on a curved wall defining the secondary combustion chamber, is that the flame gases emerging from the primary combustion chambers are well mixed in the secondary combustion chamber. This good mixing results in a more uniform temperature distribution within the secondary combustion chamber.

In another embodiment, the fuel supply of each primary combustion chamber can be connected and disconnected, so that the excess-air coefficient in the primary combustion chambers in operation can be kept substantially constant throughout the load.

In still another embodiment, at least one starting burner leading to the secondary combustion chamber is provided in the region of the primary combustion chambers. This starting burner is advantageously disposed in the center of the curved wall of the secondary combustion chamber i.e. in the center of the spherical array of primary combustion chambers. This starting burner allows the gas turbine plant to be started in a simple manner without using the primary combustion chambers. In this stage the gas turbine is brought from ignition speed to synchronous speed without load. As the starting burner flame spreads out in the shape of a bell in the secondary combustion chamber, ignition of those primary combustion chambers adjacent the flame which are to be put into operation first is facilitated.

These and other objects and advantages of the invention will become more apparent from the following detailed description and appended claims taken in conjunction with the accompanying drawings in which:

Figure 5:
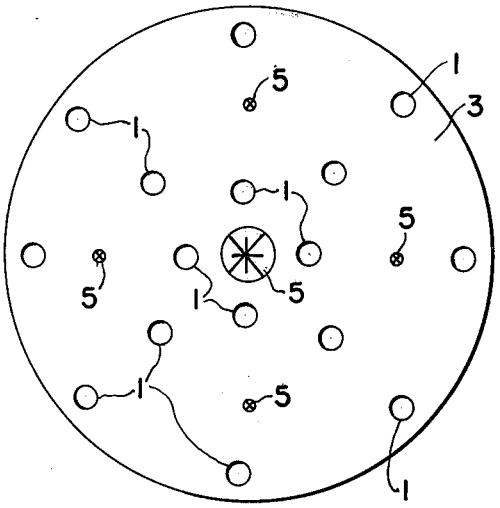
Figure 4:
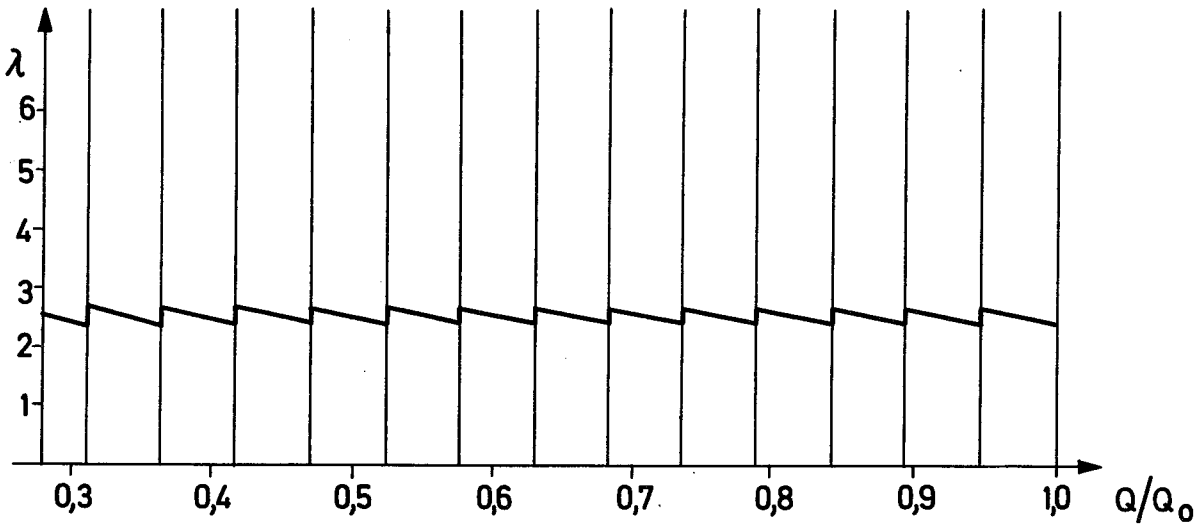

FIG. 4 graphically illustrates the operation of the system according to the invention; and FIG. 5 illustrates a plan view of an array of starting burners and primary combustion chambers in accordance with the invention.

Figure 1:
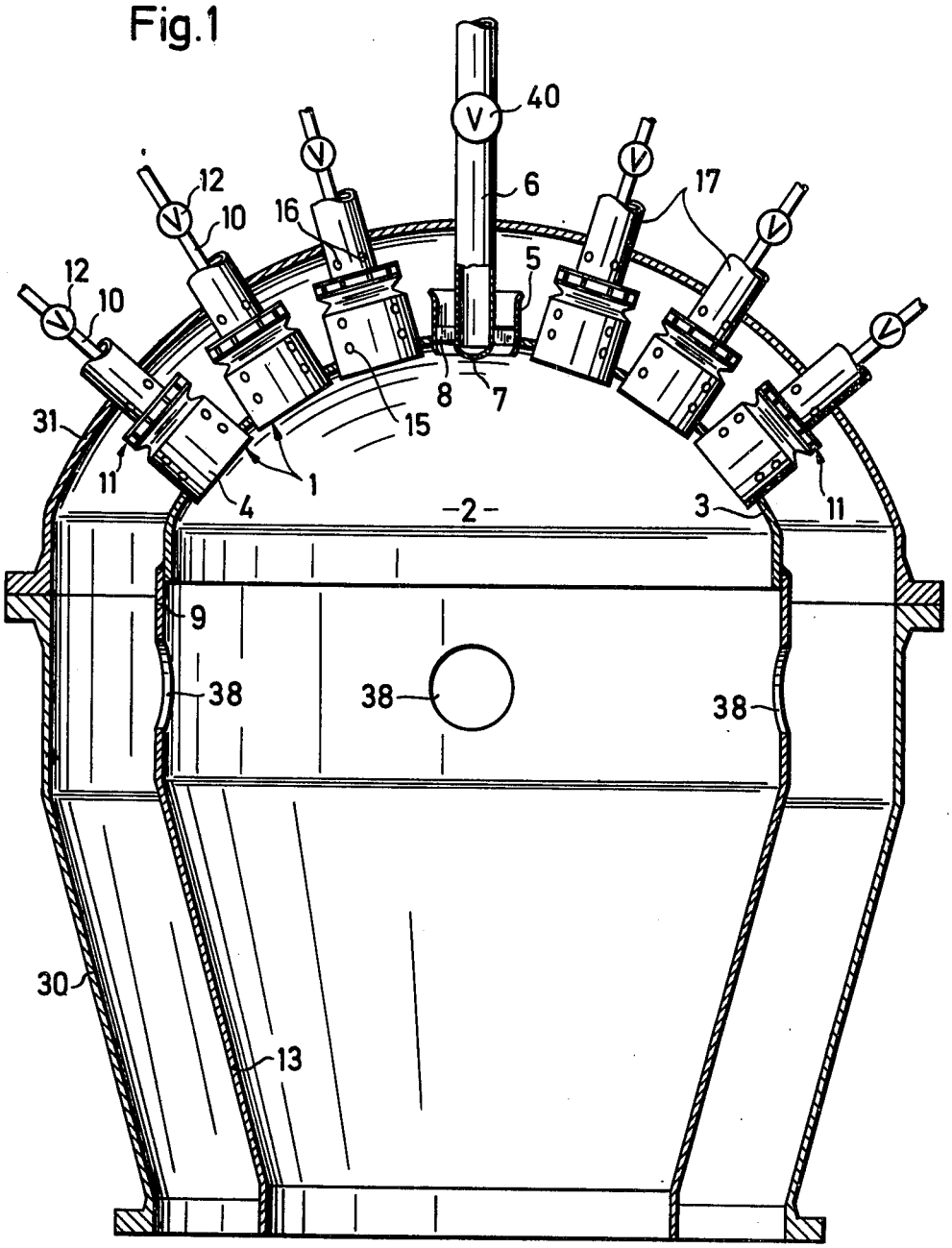
FIG. 1 illustrates a simplified vertical sectional view of a combustion system according to the invention.

Referring to FIG. 1, the combustion system consists essentially of a number of primary burner chambers 1, for example 40 such chambers, and a secondary combustion chamber 2. With reference to FIG. 1, the primary combustion chambers 1 are distributed spherically over a top spherically curved boundary wall 3 of the combustion chamber 2. Each primary combustion chamber 1 is constructed of a shell 4 which defines the combustion chamber and an individualized fuel and air supply means in the form of a fuel supply 10 and an air supply 11. The fuel supply 10 is provided with a means such as a valve 12 for individually connecting and disconnecting the fuel supply 10 to the combustion chamber 1.

The axes of the substantially cylindrical primary combustion chambers 1 are perpendicular to the spherically curved boundary wall 3, so that the axes of all the combustion chambers 1 meet at practically the same point. As shown in FIG. 1, the bottom part of the boundary wall 3 of the secondary combustion chamber 2 is followed by a cylindrical tubular portion 9 which continues in the form of a frusto-conical tubular portion 13. A surrounding shell 30 is spaced from the secondary combustion chamber 2 and is of a shape which corresponds to the shape of the tubular portions 9 and 13. This shell 30 is connected at the top, as viewed, by a spherical hood 31 through which guide tubes 17 extend for the burners of the primary combustion chambers 1. The secondary combustion chamber 2 is therefore substantially symmetrical with respect to an axis of rotation.

A starting burner 5 is provided at the center of the spherically curved boundary wall 3 and consists of a fuel supply pipe 6 provided with a valve 40. The pipe 6 leads to a nozzle 7 which is surrounded by a swirl air supply system 8. This starting burner 5 does not therefore have its own combustion chamber but leads directly into the secondary combustion chamber 2.

Figure 3:
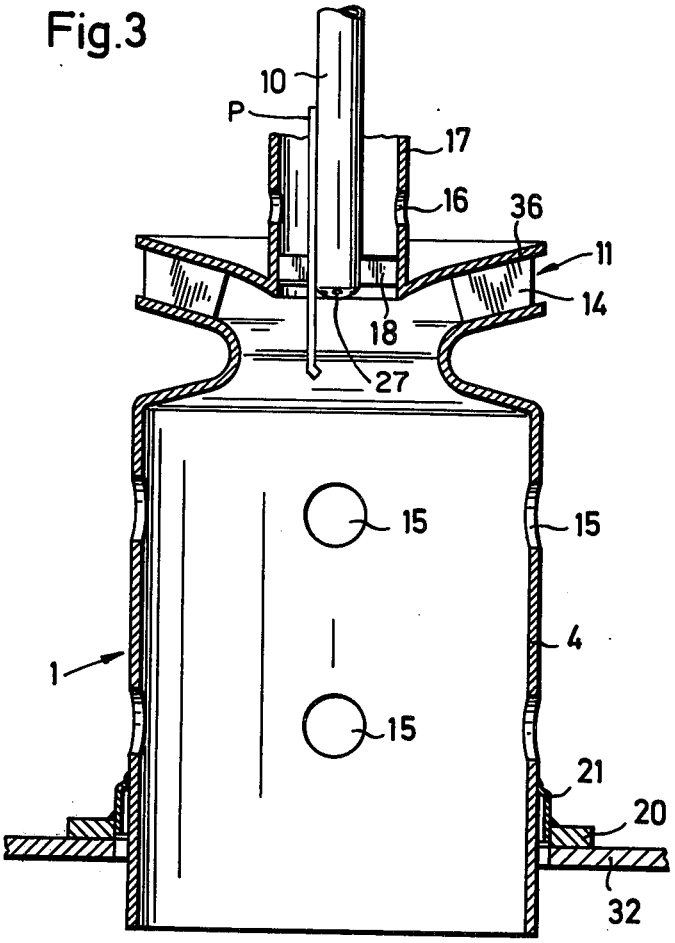
FIG. 3 illustrates a further modified mounting of a primary combustion chamber.

Referring to FIG. 3, the top end of the shell 4 of the primary combustion chambers 1 is constricted and provided with swirl baffles 14 which, together with a conical wall 36, form the air supply 11. The cylindrical shell or wall 4 of each primary combustion chamber 1 is also formed with a plurality of holes 15 through which additional air for combustion can enter the primary combustion chamber 1. Apart from the air supply 11, where the air is rotated at the swirl plates 14, and the air supply through the holes 15, a third air supply exists via holes 16 formed in the guide tube 17 surrounding the fuel nozzle 27. The air entering via the holes 16 also receives a rotating eddy motion by means of a swirl device 18 and emerges into the primary combustion chamber 1 near the fuel emerging in finely-divided form from the nozzle 27. The air streams emerging from the swirl devices 18 and 14 provide intensive mixing of the air and fuel. Each primary combustion chamber 1 can be provided with a pilot burner P.

As shown in FIGS. 1 and 3, the shell 4 of the primary combustion chamber 1 is supported near the bottom end on a support plate 32 which forms the spherically curved boundary wall 3. The support is, for example, provided by a ring 20 which encloses the shell 4 and rests on the plate 32. This ring 20 is connected to the shell 4 via an axially extending sleeve 21.

Figure 2:
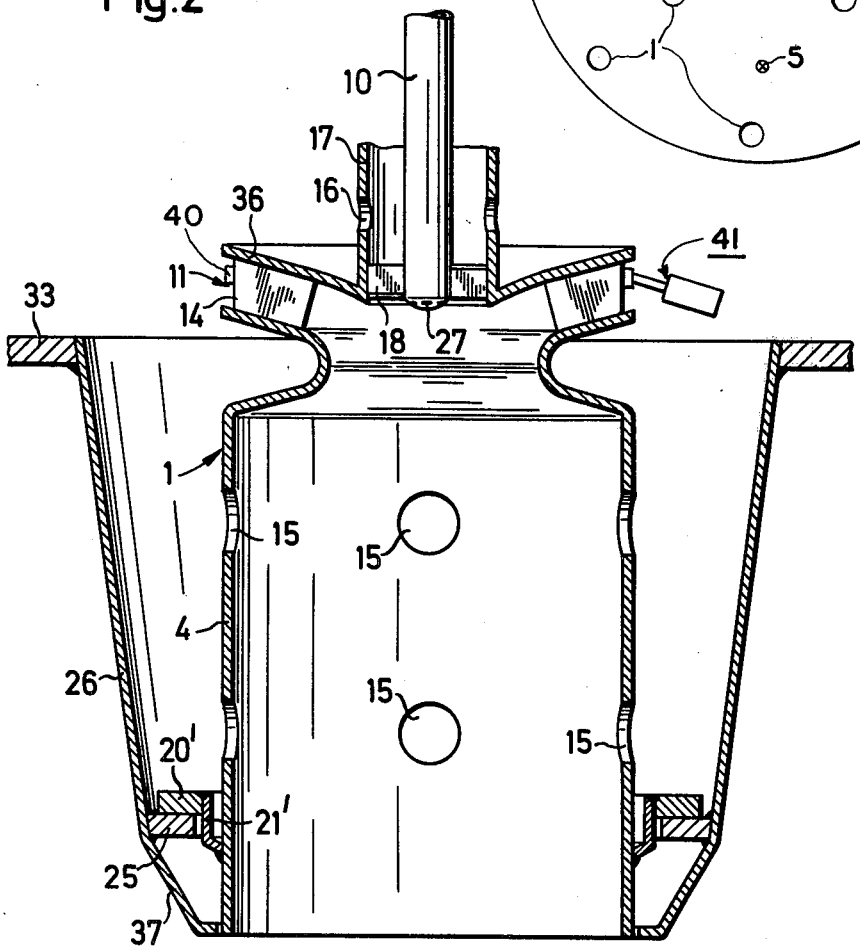
FIG. 2 illustrates a vertical partial sectional view through a primary combustion chamber which is mounted in a modified manner relative to the secondary combustion chamber.

Referring to FIG. 2, wherein like reference characters indicate like parts as above, the primary combustion chamber 1 may alternatively be mounted near the bottom end, but not directly on a plate forming the boundary wall 3. In this case, each primary combustion chamber 1 is mounted on a ring 25 which surrounds the combustion chamber 1 with clearance and which is connected to a support plate 33 via a slightly conical tube 26 coaxial with the combustion chamber 1. The combustion chamber 1 rests on the ring 25 by way of a ring 20' which is connected to the shell 4 via a sleeve 21'. The tube 26 extends beneath the ring 25 in the form of a truncated cone 37 as far as the bottom end of the combustion chamber 1. The tube 26 may alternatively be cylindrical.

The primary combustion chambers 1 are so constructed that the loading in each of them, for example 15,000 to 30,000 $kW/m^2$ bar, is higher than in the secondary combustion chamber 2.

In operation, only the starting burner 5 is ignited to start the gas turbine plant. The air required for combustion comes from a compressor (not shown) and flows through the space defined between the secondary combustion chamber 2 and the shell 30 and spherical hood 31. The air is rotated in the swirl device 8 and is mixed with the fuel emerging from the nozzle 7.

On changeover to an on-load operation, i.e. after the on-load speed or synchronous speed of the gas turbine has been reached, the primary combustion chambers 1 are successively brought into operation by opening the associated valve 12 in the corresponding fuel supply line 10. Those combustion chambers 1 which are situated nearest the starting burner are then the first to be operated. Thereafter, successive primary combustion chambers 1 are ignited by the flames of adjacent primary combustion chambers 1. As one or more primary combustion chambers 1 are brought into operation, the air excess coefficient increases somewhat in each case and then drops again as the fuel supply increases. This results in the sawtooth curve shown in FIG. 4, which illustrates the air-excess coefficient of the primary combustion chambers 1 over the fuel flow. The sawtooth curve thus shows that the air-excess coefficient in the primary combustion chambers 1 remains substantially constant over the entire load range. It is therefore possible to operate even under partial load conditions with the system described. The starting burner 5 can be disconnected on operation in the top load range and at full load.

The length of the primary combustion chambers 1 is so selected that the combustion process is not completed in them. This means that the flames project from the primary combustion chambers 1 into the secondary combustion chamber 2, in which a common compact secondary flame forms, and becomes intensively mixed together. This common secondary flame ensures reliable ignition as the primary combustion chambers 1 are brought into operation. The finely-divided fuel entering each primary combustion chamber 1 through a nozzle 27 is intimately mixed with the two air streams supplied by the swirl devices 18 and 14 and after partial combustion passes relatively rapidly into the secondary combustion chamber 2 where complete combustion then takes place. At the same time, part of the air which comes from the compressor (not shown) reaches the secondary flame through holes 38 in the tubular portion 9. The fuel thus has a short retention time in the primary combustion chambers 1. This short, retention time, together with the high excess-air coefficient, the top limit of which is defined by the extinction limit, i.e. the extinction of the flame, results in a reduction of the $NO_x$ content of the gases. The gases reach the gas turbine (not shown) via the conical tubular portion 13.

If some of the primary combustion chambers 1 are disconnected during part-load operation, the air supply is maintained at the disconnected primary combustion chambers 1.

The primary combustion chambers may alternatively be constructed with a means for adjusting the air supply, for example at the swirl baffles 14. Such means may be of any suitable type, e.g. to adjust the cross-section of the air entry via pistons, slides, flap-control or the like. To this end the adjusting means may include a ring 40 secured to the baffles 14 which are pivotally mounted in the wall 36 and a piston-cylinder arrangement 41 articulated to the ring 40 to move the ring 40 and thus the baffles 14. The particular adjusting means are of constructions similar in principle to constructions as described in U.S. Pat. Nos. 3,612,737; 3,649,155 and 3,723,049. The excess-air coefficient in the primary combustion chambers can, thus, also be kept substantially constant throughout the load. In that case, all the primary combustion chambers remain in operation at part-load.

Instead of one starting burner, a number of starting burners may be distributed between the primary combustion chambers 1 as indicated in FIG. 5.

The "excess air coefficient" may be expressed as the ratio of the air/fuel ratio during operation to the theoretical air requirement per kilogram of fuel. In FIG. 4, the designation Q represents the heating capacity of a fuel, i.e. the amount of heat produced by the supplied fuel per unit of time, divided by the load (variable) whereas $Q_o$ represents the fuel flow (heat) at full load.

What is claimed is:

1. A gas turbine combustion system comprising a large secondary combustion chamber having a spherical wall about one end;

a plurality of smaller primary combustion chambers disposed in a spherical array on said wall, each primary combustion chamber having a wall extending through said spherical wall and terminating in an outlet directed into said secondary combustion chamber and each primary combustion chamber being of a length whereby combustion is not completed therein and being operative to project a flame into said secondary combustion chamber for igniting a mixture of fuel and air in an adjacent primary combustion chamber;

at least one starter burner disposed in the center of said spherical array of primary combustion chambers; and means for supplying fuel and means for supplying air to each said primary combustion chamber, at least some of said air supply means being adjustable to control the supply of air.

2. A gas turbine combustion system as set forth in claim 1 which further includes means for individually disconnecting selective ones of said fuel supply means from a primary combustion chamber.

3. A gas turbine combustion system as set forth in claim 1 wherein the loading ($kW/m^2$ bar) of each said primary combustion chamber is greater than the loading of said secondary combustion chamber.

4. A gas turbine combustion system as set forth in claim 1 wherein each primary combustion chamber has a surrounding wall including apertures for the passage of additional air into said respective primary combustion chamber for combustion.

5. A gas turbine combustion system as set forth in claim 1 which further comprises a pilot burner in each said primary combustion chamber.

6. A gas turbine combustion system comprising a large secondary combustion chamber having a spherical wall about one end;

a plurality of smaller primary combustion chambers disposed in a spherical array on said wall, each primary combustion chamber and each primary combustion chamber being of a length whereby combustion is not completed therein and being operative to project a flame into said secondary combustion chamber for igniting a mixture of fuel and air in an adjacent primary combustion chamber;

a number of starting burners distributed between said primary combustion chambers; and means for supplying fuel and means for supplying air to each said primary combustion chamber, at least some of said air supply means being adjustable to control the supply of air.

* * * * *

UNITED STATES PATENT AND TRADEMARK OFFICE

CERTIFICATE OF CORRECTION

PATENT NO. : 4,073,134

DATED : February 14, 1978

INVENTOR(S) : Hans Koch

It is certified that error appears in the above–identified patent and that said Letters Patent are hereby corrected as shown below:

In the abstract, line 3 change "nitrous" to -- nitric --

Column 1, line 17, change "nitrous" to -- nitric --
Column 1, line 19, change "nitrous" to -- nitric --
Column 1, line 20, change "nitrous" to -- nitric --
Column 1, line 26, change "nitrous" to -- nitric --
Column 1, line 38, change "nitrous" to -- nitric --
Column 4, line 40 change "results" to -- result --
Column 6, lines 18-19 delete "and each primary combustion chamber"

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*